US006734771B2

(12) United States Patent
Okita et al.

(10) Patent No.: US 6,734,771 B2
(45) Date of Patent: May 11, 2004

(54) INDUCTOR COMPONENT HAVING A PERMANENT MAGNET IN THE VICINITY OF MAGNETIC GAP

(75) Inventors: Kazuyuki Okita, Sendai (JP); Toru Ito, Miyagi (JP); Toshiya Sato, Sendai (JP); Teruhiko Fujiwara, Sendai (JP)

(73) Assignee: NEC Tokin Corporation, Sendai (JP)

( * ) Notice: Subject to any disclaimer, the term of this patent is extended or adjusted under 35 U.S.C. 154(b) by 0 days.

(21) Appl. No.: 10/016,038

(22) Filed: Nov. 16, 2001

(65) Prior Publication Data

US 2002/0089400 A1 Jul. 11, 2002

(51) Int. Cl.[7] ..... H01F 7/08; H01F 21/00
(52) U.S. Cl. ..... 335/229; 336/110
(58) Field of Search ..... 335/229, 227–231; 336/110, 233, 178, 212

(56) References Cited

U.S. PATENT DOCUMENTS

| | | | | | |
|---|---|---|---|---|---|
| 2,774,935 | A | | 12/1956 | Rademakers et al. | |
| 3,968,465 | A | * | 7/1976 | Fukui et al. | 336/110 |
| 4,103,221 | A | * | 7/1978 | Fukui et al. | 323/362 |
| 4,456,898 | A | | 6/1984 | Frischmann | |
| 5,841,335 | A | * | 11/1998 | Onishi et al. | 336/170 |
| 6,014,071 | A | * | 1/2000 | Onishi et al. | 336/170 |
| 6,304,460 | B1 | * | 10/2001 | Cuk | 363/16 |
| 2002/0033747 | A1 | * | 3/2002 | Ito et al. | 336/178 |
| 2002/0097131 | A1 | * | 7/2002 | Kondo | 336/212 |

FOREIGN PATENT DOCUMENTS

| | | | | |
|---|---|---|---|---|
| DE | 22 26 289 | | 1/1973 | |
| EP | 0 744 757 | | 11/1996 | |
| JP | 54-152957 | U | 10/1979 | |
| JP | 54152957 | A * | 12/1979 | H01J/1/15 |
| JP | 61024211 | A * | 2/1986 | H01F/37/00 |
| JP | 1-169905 | A | 7/1989 | |
| JP | 2000216033 | A * | 8/2000 | H01F/37/00 |

OTHER PUBLICATIONS

Patent abstracts of Japan, vol. 1997, No. 12, Dec. 25, 1997 1997–12–25; and JP 09–213546 A (Yaskawa Electric Corp.), Aug. 15, 1997 (1997–08–15)–Abstract only.

* cited by examiner

*Primary Examiner*—Lincoln D. Donovan
*Assistant Examiner*—Bernard Rojas
(74) *Attorney, Agent, or Firm*—Frishauf, Holtz, Goodman & Chick, P.C.

(57) ABSTRACT

An inductor component is provided which includes a magnetic core having at least one gap, an excitation coil disposed on the magnetic core so as to form a magnetic path on the magnetic core, at least one permanent magnet disposed near the at least one gap, and at least one first soft magnetic material piece disposed between the at least one permanent magnet and the magnetic core, wherein the first soft magnetic material piece is formed of a soft magnetic material which has a smaller permeability and less eddy current loss than the magnetic core.

12 Claims, 12 Drawing Sheets

INDUCTOR COMPONENT HAVING A PERMANENT MAGNET IN THE VICINITY OF MAGNETIC GAP

BACKGROUND OF THE INVENTION

1. Field of the Invention

The present invention relates to a magnetic element comprising a coil wound onto a magnetic core, and more specifically relates to an inductor component such as an inductor and transformer and the like which is used in various types of electronic equipment and in electric power sources, for reducing core loss using DC bias.

2. Description of the Related Art

In recent years, various types of electronic equipment are being reduced in size and weight. Accordingly, the relative volume percentage of the electric power source units of such electronic equipment has tended to increase with respect to the overall volume of the electronic equipment. This is due to the fact that, while various types of circuits are being contained in LSIs, reduction of size of magnetic parts such as inductors and transformers which are indispensable circuit components for electric power source units is difficult. Hence, various methods have been attempted for reducing electrical power source units in size and weight.

Magnetic elements such as inductors and transformers (which will hereafter be collectively referred to as "inductor components") can be effectively reduced in size and weight by reducing the volume of magnetic cores formed of magnetic materials.

Generally, reduction in the size of cores facilitates magnetic saturation of the magnetic core, which is problematic in that the current value which can be handled as a power source is reduced.

As a means for solving this problem, an art is known wherein a part of a magnetic core contains magnetic gaps, thereby increasing the magnetic resistance of the magnetic core and preventing reduction in current value. However, the fact that the magnetic inductance of such magnetic parts deteriorates is also known.

Various methods are known for preventing deterioration of magnetic inductance of inductor components, such as a method of disposing a permanent magnet near a gap (hereafter referred to as "prior art 1"), a method for bridging a gap using a permanent magnet (see Japanese Unexamined Utility Model Publication No. 54-152957), or a method for connecting a gap by mounting a permanent magnet thereto (see Japanese Unexamined Patent Application Publication No. 1-169905, hereafter referred to as "prior art 2"), thereby applying DC bias, and increasing the change in magnetic flux density, so as to increase processing electric power.

Prior art 2 describes a technique relating to the structure of a magnetic core using a permanent magnet for generating magnetic bias. This technique involves a method inwhich DC magnetic bias is applied to a magnetic core using a permanent magnet, consequently increasing the number of lines of magnetic force capable of permeating the magnetic gap.

However, in the event that a metal magnetic material having a high-saturation magnetic flux density (B), e.g., silicone steel, permalloy, amorphous material, is used as the magnetic core for the choke coil according to prior art 1, the permanent magnet formed of sintered material, e.g., rare-earth magnets such as Sm—Co or Nd—Fe—B or the like, generate heat from eddy current loss due to the high magnetic flux density of the magnetic core even if positioned outside the path of magnetism, so the properties of the permanent magnet deteriorate.

Also, with the configuration of the magnetic core of the inductor according to prior art 2, magnetic fluxes from a coil wound on a magnetic core pass through the permanent magnet within the magnetic gap, causing a problem of demagnetizing the permanent magnet. Also, there has been the problem in that the smaller the form of the permanent magnet inserted in the magnetic gap is, the greater the effects of demagnetizing due to external factors is.

SUMMARY OF THE INVENTION

Accordingly, it is an object of the present invention to provide an inductor component in which few restrictions exist with regard to the form of the positioned permanent magnet, generation of heat of the permanent magnet due to the magnetic flux from the coil wound on the magnetic core is suppressed, and in which properties do not deteriorate.

According to the present invention, there is provided an inductor component which comprises a magnetic core comprising at least one gap, an excitation coil disposed on the magnetic core so as to form a magnetic path on the magnetic core, at least one permanent magnet disposed near the at least one gap, and at least one first soft magnetic material piece disposed between the at least one permanent magnet and the magnetic core, wherein the first soft magnetic material piece is formed of a soft magnetic material which has a smaller permeability and less eddy current loss than the magnetic core.

DESCRIPTION OF THE PREFERRED EMBODIMENTS

Before describing the embodiments of the present invention, description will be made of magnetic parts according to prior art with reference to FIGS. 1A through 3, to facilitate understanding of the present invention.

Figure 1A:
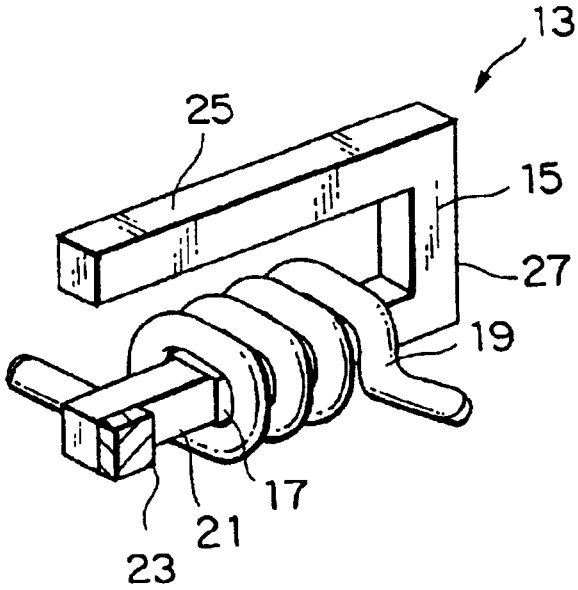
FIG. 1A PRIOR ART
FIG. 1A is a perspective view illustrating a choke coil according to the prior art 1.
Figure 1B:
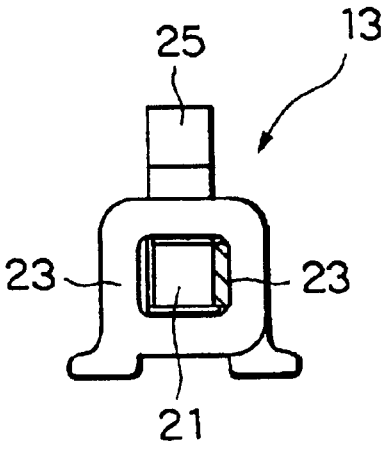
FIG. 1B PRIOR ART
FIG. 1B is a frontal view of the choke coil shown in FIG. 1A.
Figure 1C:
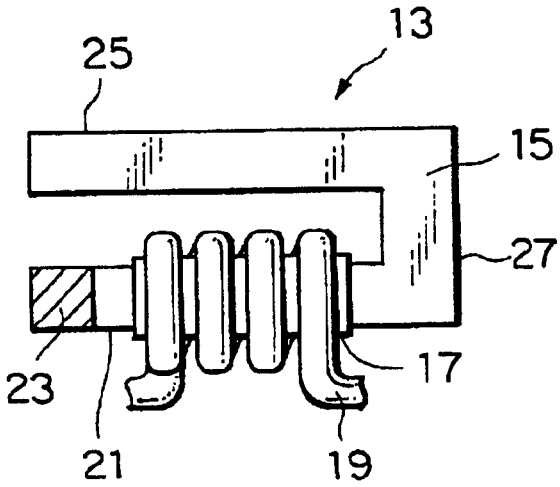
FIG. 1C PRIOR ART
FIG. 1C is a side view of the choke coil shown in FIG. 1A.

Referring to FIGS. 1A through 1C, a choke coil 13 according to prior art 1 comprises a magnetic core 15 formed of a U-shaped soft magnetic material, and an excitation coil 19 wound thereupon with an insulating sheet 17 introduced therebetween. Also, a permanent magnet 23 is attached to the side face of the edge of one of magnetic poles 21 and 25 facing one another, namely the magnetic pole 21, of the magnetic core 15.

Figure 2:
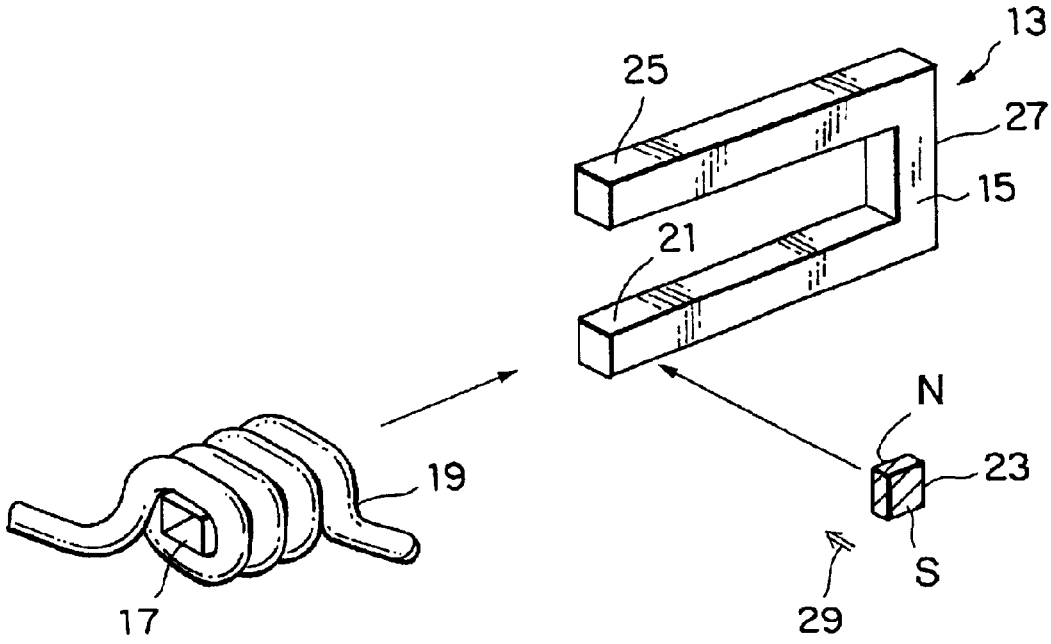
FIG. 2 PRIOR ART
FIG. 2 is a disassembled perspective view of the choke coil shown in FIGS. 1A through 1C.

Referring to FIG. 2, the excitation coil 19 is mounted on the one magnetic pole 21 of the magnetic core 15 formed of a U-shaped soft magnetic material by winding a lead around with the insulating sheet 17 introduced therebetween, thereby forming the choke coil 13. Next, the permanent magnet 23 is attached to the front of the edge of one magnetic pole 21 of the pair of magnetic poles. Note that symbols N and S accompanying the permanent magnet 23 and, therefore the arrow 29 indicate the direction of the magnetic field.

Figure 3:
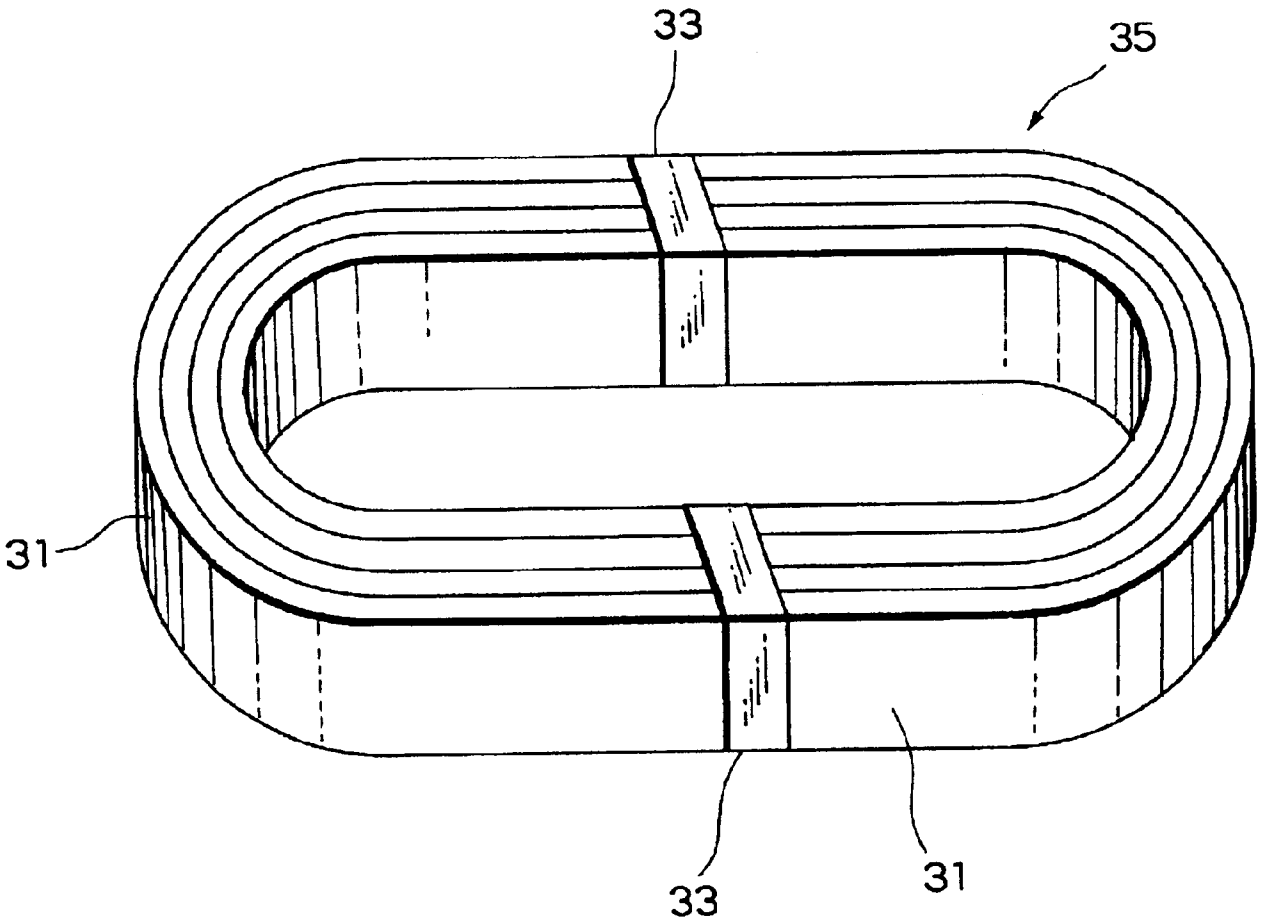
FIG. 3 PRIOR ART
FIG. 3 is a perspective view illustrating a magnetic part according to the prior art 2.

Making reference to FIG. 3, with the magnetic component according to prior art 2, permanent magnets 33 are inserted into each of the two magnetic gaps provided between a pair of U-type magnetic cores 31. With the magnetic part 35 according to the prior art 2, inserting the permanent magnets 33 into the magnetic gaps enables high magnetic inductance values to be maintained at great current values, with regard to the inductance/DC superimposed current properties thereof.

Next, the present invention will be described in further detail with reference to FIGS. 4 to 13.

The inductor component according to the present invention comprises a magnetic core comprising at least one gap, an excitation coil disposed on the magnetic core so as to form a magnetic path on the magnetic core, and permanent magnets disposed near at least one of the gaps. In the inductor component, permanent magnet is disposed across from a first soft magnetic material piece formed of a soft magnetic material which has smaller permeability and less eddy current loss than the magnetic core.

Now, with this inductor component, one edge face of the permanent magnets is preferably joined each to both side faces forming at least one gap of the magnetic core with the first soft magnetic material piece introduced therebetween, with the other edge faces of the both permanent magnets connected by a second soft magnetic material piece formed of a soft magnetic material which has smaller permeability and less eddy current loss than the magnetic core.

Also, with the inductor component, the gap is preferably formed of one U-shaped magnetic core, with a plurality of the gaps formed between a pair of magnetic cores.

Also, with the inductor component, the gaps are preferably formed on each abutting edge face of C-type cores.

Further, the inductor component, the inductor component is preferably used for a choke coil.

Now, the permanent magnet used with the present invention is a bond magnet formed of rare-earth magnet powder having a natural coercive force of 10 kOe (79 kA/m) or more, Tc of 500° C. or more, and average grain diameter of 2.5 to 50 $\mu$m, and resin of 30% or more by volume, with a specific resistance of 1 Ωcm or more. More preferably, the composition of the rare-earth alloy is Sm $(Co_{ba1}.Fe_{0.15-0.25}Cu_{0.05-0.06}Zr_{0.02-0.03})_{7.0-8.5}$, the type of resin used for the bond magnet is one of polyimide resin, epoxy resin, polyphenyl sulfite resin, silicon resin, polyester resin, nylon of aromatics, or chemical polymers, with a silane coupling agent and titanium coupling agent added to the rare-earth magnet powder and given anisotropic properties by magnetic orientation at the time of fabricating the bond magnet in order to yield high properties, wherein magnetizing the bond magnet following assembly under a magnetizing field of 2.5 T or stronger allows excellent DC superimposing properties to be obtained, while forming a magnetic core with no deterioration in core loss properties.

This is due to the fact that natural coercive force is more necessary than the energy product as magnetic properties for obtaining excellent DC superimposing properties, and accordingly, sufficiently high DC superimposing properties can be obtained even using a permanent magnet with high specific resistance, as long as the natural coercive force is high.

Magnets with high specific resistance and also with high natural coercive force can generally be obtained by a rare-earth bond magnet formed by mixing rare-earth magnet powder with a binder, but any composition may be used as long as the composition is a magnet powder with a high coercive force. Types of rare-earth magnet powders include SmCo types, NdFeB types, and SmFeN types, but a magnet with Tc of 500° C. or higher and coercive force of 10 kOe or more is necessary when the reflow conditions and anti-oxidation are taken into condition, so at the present, an $Sm_2Co_{17}$ magnet is preferable.

Now, embodiments of the present invention will be described with reference to FIGS. 4 through 13.

Figure 4A:
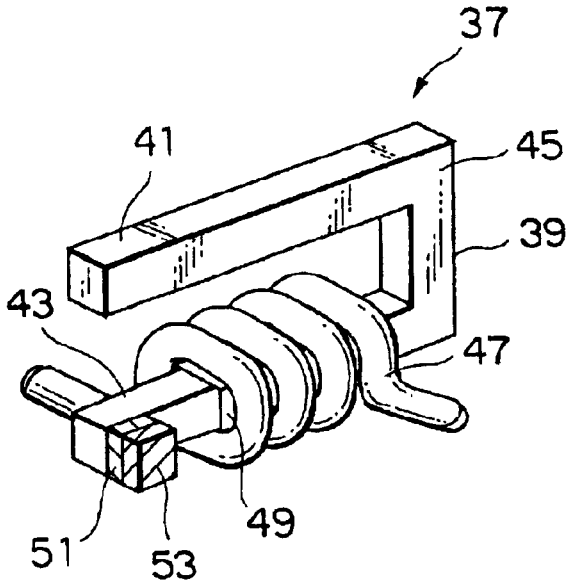
FIG. 4A is a perspective view of an inductor component according to a first embodiment of the present invention.
Figure 4B:
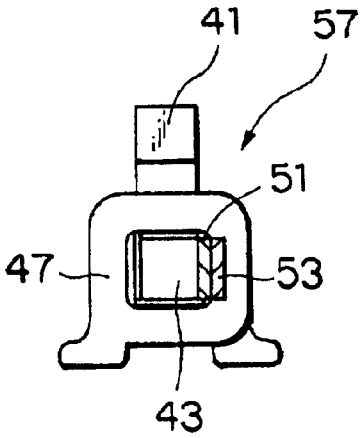
FIG. 4B is a frontal view of the inductor component shown in FIG. 4A.
Figure 4C:
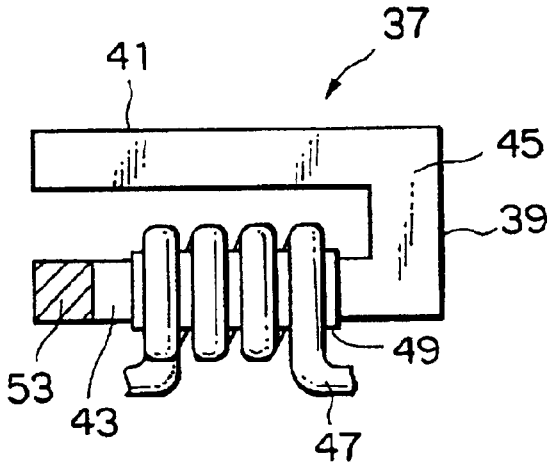
FIG. 4C is a side view of the inductor component shown in FIG. 4A.

Referring to FIG. 4, an inductor component 37 according to the first embodiment of the present invention comprises a magnetic core 45 and an excitation coil 47. The magnetic core 45 is a U-shaped soft magnetic material having a base 39 and a pair of poles 41 and 43 extending in the same direction from the ends of the base 39. Examples of materials which can be used for the magnetic core 45 include metal soft magnetic materials such as silicone steel, amorphous material, Permalloy, etc., or soft magnetic materials of such as MnZn or NiZn ferrite or the like.

The excitation coil 47 is mounted on one of the magnetic poles of the magnetic core 45. The excitation coil 47 has a form of being wound on the magnetic pole with an insulation sheet 49 such as insulating paper, insulating tape, a plastic sheet, etc., being introduced therebetween.

Also, a soft magnetic member piece 51 formed of a rectangular-plate-shaped soft magnetic material is on one side face of the end of one magnetic pole 43 of the magnetic core 45. Further, a permanent magnet 53 of the same shape is upon the soft magnetic member piece 51.

The soft magnetic member piece 51 is of a material which has smaller permeability and less eddy current loss than the magnetic core 45, e.g., dust soft magnetic material such as silicone steel, amorphous material, Permalloy, etc. Also, a bond magnet or a rare-earth sintered member such as Ba or Sr ferrite or SmCo, NdFeB, etc., is used for the permanent magnet 43.

Figure 5:
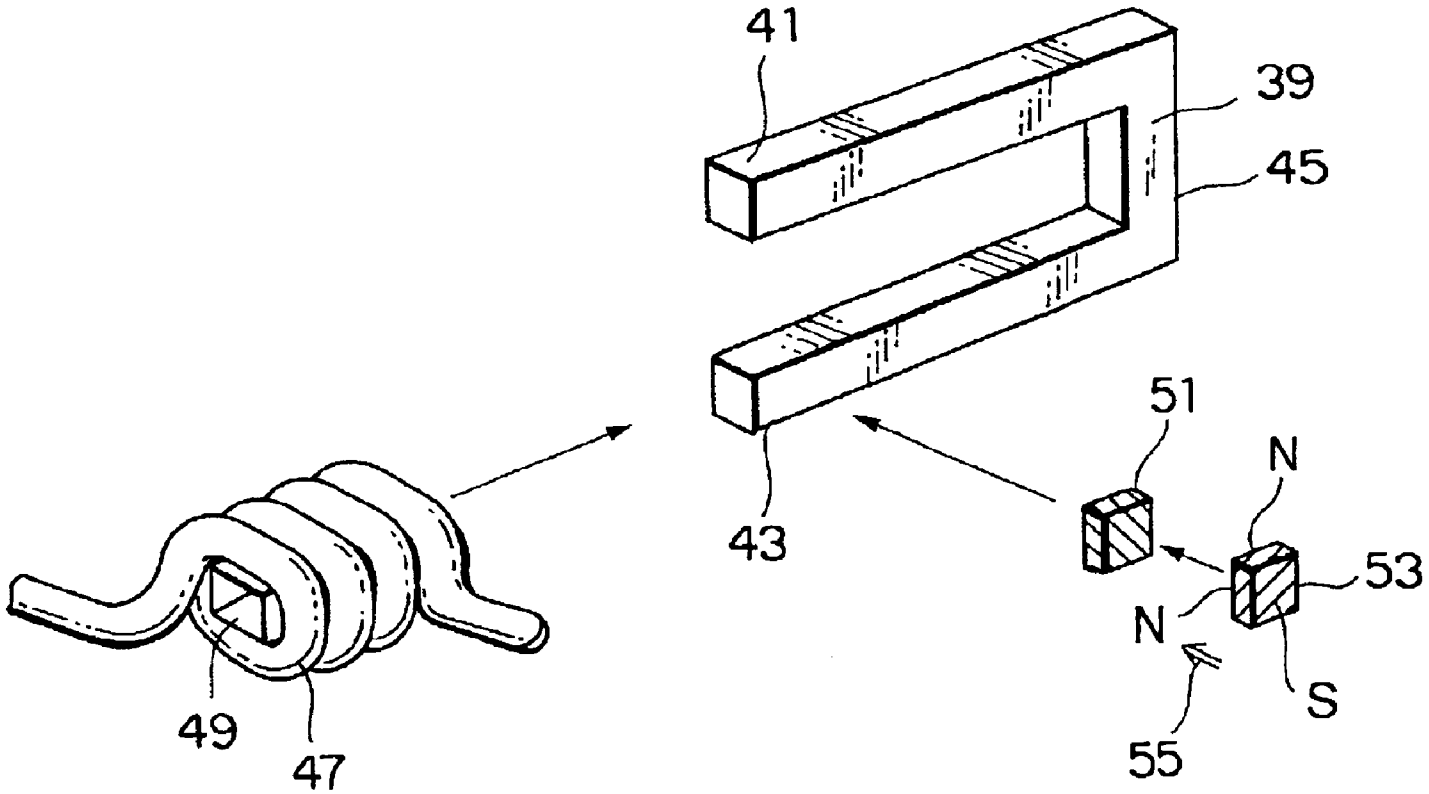
FIG. 5 is a disassembled perspective view of the inductor component shown in FIG. 4A.

Referring to FIG. 5, the inductor component 37 is manufactured by mounting the excitation coil 47 on one of the magnetic poles of the magnetic core 45 via the insulating sheet 49, and the permanent magnet 53 is disposed on the side face of the magnetic pole to which the excitation coil 47 has been disposed, via the soft magnetic member piece 51. Note that an arrow 55 indicates the direction of the magnetic field.

With an inductor component 37 having such a configuration, the magnetic field formed by the excitation coil 47 and the permanent magnet 53 forming a bias magnetic field are separated by the soft magnetic member piece 51, so the permanent magnet 53 is not affected by the magnetic field formed by the excitation coil 47, and accordingly, there no heat is generated by the eddy current loss from the magnetic field, so the permanent magnet is unaffected by demagnetization or the like, and a highly-reliable inductor component 37 having stable and excellent properties can be provided.

Figure 6A:
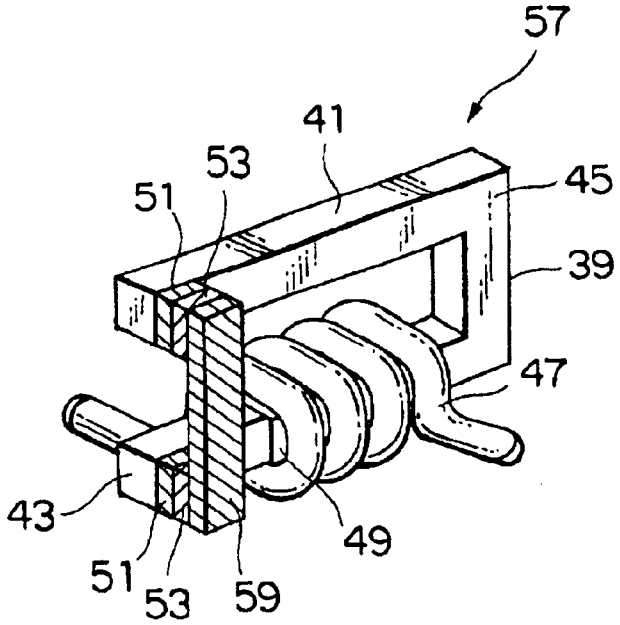
FIG. 6A is a perspective view of an inductor component according to a second embodiment of the present invention.
Figure 6B:
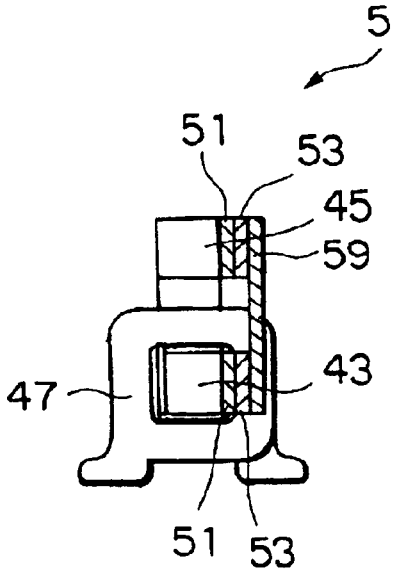
FIG. 6B is a frontal view of the inductor component shown in FIG. 6A.
Figure 6C:
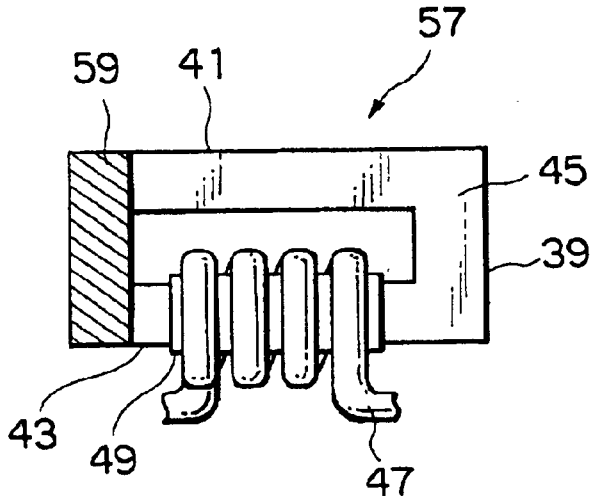
FIG. 6C is a side view of the inductor component shown in FIG. 6A.

Referring to FIGS. 6A through 6C, similar parts will be represented by the same reference numbers. An inductor component 57 according to the second embodiment of the present invention comprises the magnetic core 45 of the same U-shaped soft magnetic member as with the first embodiment, and the excitation coil 47 mounted on one of the magnetic poles 43 of the magnetic core 45. The excitation coil 47 has a form of being wound on the magnetic pole 43 with the insulation sheet 49 such as insulating paper, insulating tape, a plastic sheet, etc., being introduced therebetween.

Also, soft magnetic member pieces 51 formed of rectangular-plate-shaped soft magnetic material are each disposed on the side faces on the same side of the ends of the magnetic poles 41 and 43 of the magnetic core 45, and permanent magnets 53 of the same shape as with the first embodiment are each disposed thereupon. The soft magnetic member pieces 51 are of a material which has smaller permeability and less eddy current loss than the magnetic core 45, as with the first embodiment.

Further, another soft magnetic member piece 59 formed of the same material as the soft magnetic member pieces 51 and longer than the soft magnetic member pieces 51 bridges the two permanent magnets 53 so as to connect the permanent magnets 53.

Figure 7:
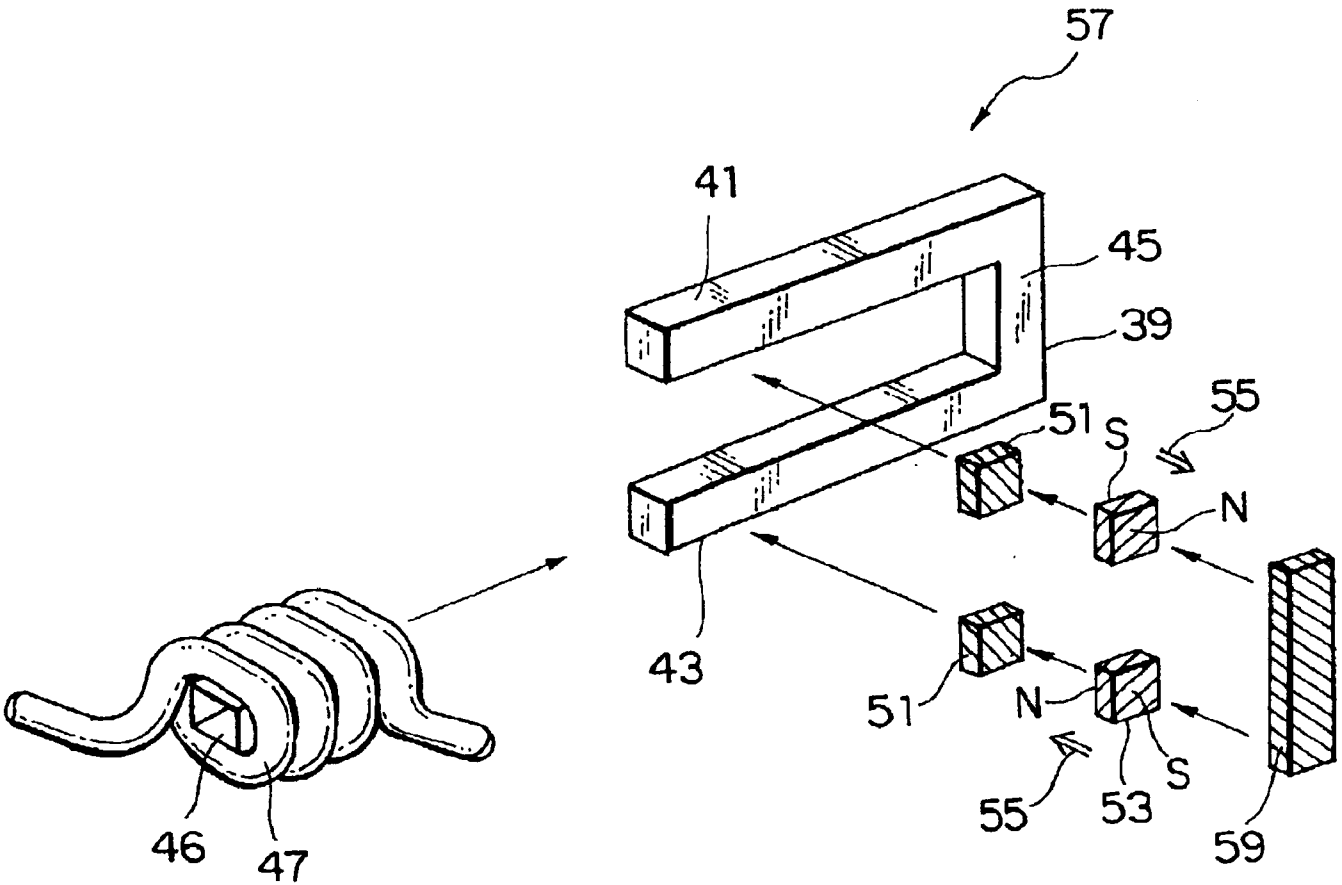
FIG. 7 is a disassembled perspective view of the inductor component shown in FIGS. 6A through 6C.

Referring to FIG. 7, the inductor component is manufactured by mounting the excitation coil 47 on one magnetic pole 43 of the magnetic core 45 via the insulating sheet 46, permanent magnets 53 are disposed on the side faces of both magnetic poles, via the soft magnetic member pieces 51, and further, another soft magnetic member piece 59 bridges the permanent magnets 53 so as to prevent leakage of magnetic flux from the permanent magnets 53. The arrow 55 indicates the direction of the magnetic field.

With such a configuration, the advantages of the first embodiment can be had, and further, the DC bias due to the permanent magnets can be increased, thereby increasing the processing electric power.

Figure 8A:
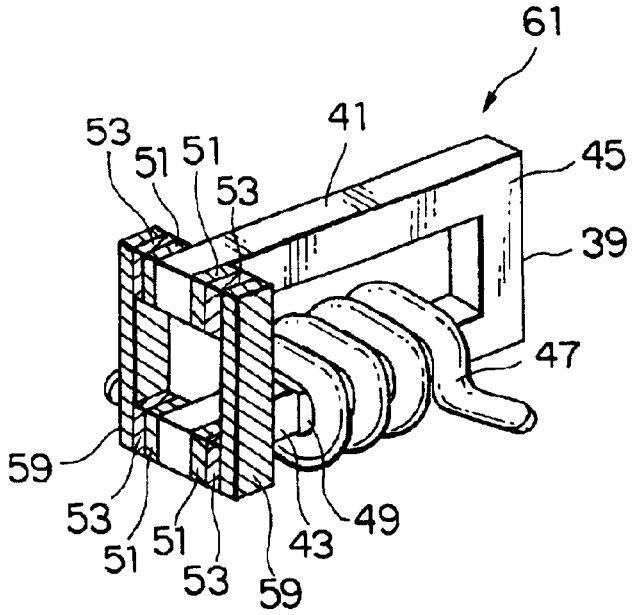
FIG. 8A is a perspective view of an inductor component according to a third embodiment of the present invention.
Figure 8B:
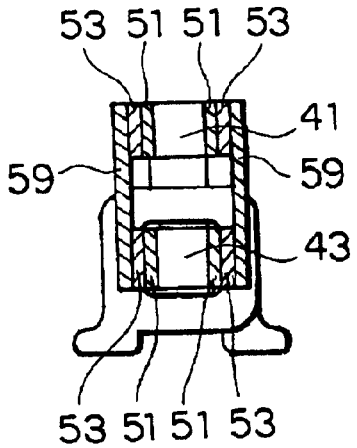
FIG. 8B is a frontal view of the inductor component shown in FIG. 8A.
Figure 8C:
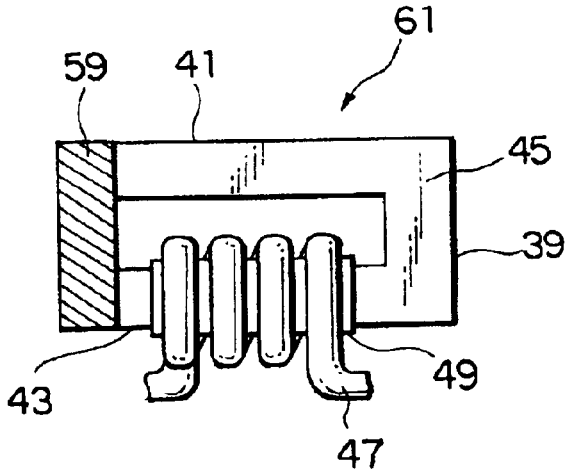
FIG. 8C is a side view of the inductor component shown in FIG. 8A.

Referring to FIGS. 8A through 8C, similar parts will be represented by the same reference numbers. An inductor component 61 according to the third embodiment of the present invention comprises the magnetic core 45 of the same U-shaped soft magnetic member as with the first and second embodiments, and the excitation coil 47 mounted on one of the magnetic poles 43 of the magnetic core 45. The excitation coil 47 has a form of being wound on the magnetic pole 43 with the insulation sheet 49 such as insulating paper, insulating tape, a plastic sheet, etc., being introduced therebetween.

Also, soft magnetic member pieces 51 formed of rectangular-plate-shaped soft magnetic material are each disposed on the side faces on both sides of the ends of the magnetic poles 41 and 43 of the magnetic core 45, i.e., a total of four soft magnetic member pieces 51 in pairs, and four permanent magnets 53 of the same shape are each disposed thereupon. The soft magnetic member pieces 51 are of a material which has smaller permeability and less eddy current loss than the magnetic core 45, as with the first and second embodiments.

Further, two other soft magnetic member pieces 59 formed of the same material as the soft magnetic member pieces 51 in the first and second embodiments and longer than the soft magnetic member pieces 51 bridge upper faces of the four permanent magnets 53 each on the same side so as to connect the permanent magnets 53 on that side.

Figure 9:
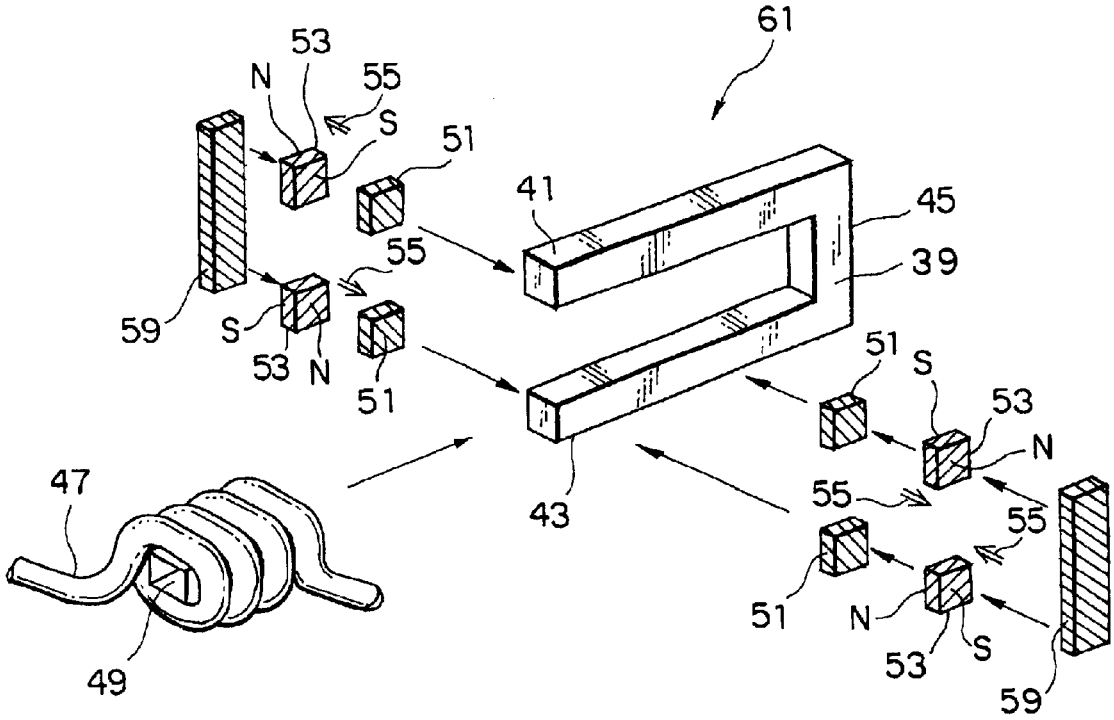
FIG. 9 is a disassembled perspective view of the inductor component shown in FIGS. 8A through 8C.
Figure 10:
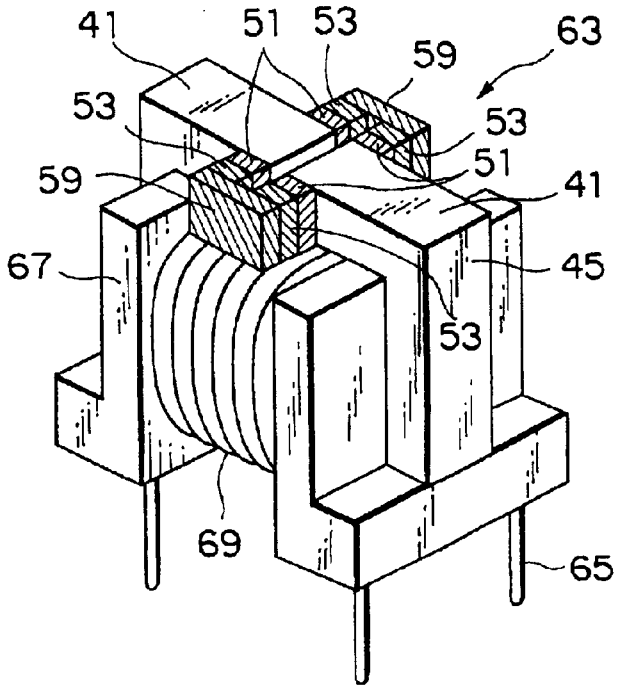
FIG. 10 is a perspective view of an inductor component according to a fourth embodiment of the present invention.

Referring to FIG. 9, the inductor component is manufactured by mounting the excitation coil 47 on one magnetic pole 43 of the magnetic core 45 via the insulating sheet 49, permanent magnets 53 are disposed on both side faces of both magnetic poles, via the soft magnetic member pieces 51, and further, other soft magnetic member piece 59 bridge each pair of the permanent magnets 53 on each side. The arrow 55 indicates the direction of the magnetic field.

With the inductor component 61 with such a configuration according to the third embodiment of the present invention, the advantages of the first and second embodiments can be had of course, and further, the DC bias due to the permanent magnets 53 can be increased, thereby increasing the processing electric power.

Referring to FIGS. 10 through 12C, similar parts will be represented by the same reference numbers. An inductor component 63 according to the fourth embodiment of the present invention comprises terminal pins 65 protruding downwards from the lower edge thereof, a coil bobbin 67 formed of a plastic material having a through hole not shown in the drawings so as to pass through the center of the winding portion, the pair of magnetic cores 45 comprising C-type soft magnetic members each with one of the magnetic poles 41 and 43 of the core mounted to the through hole (not shown) of the coil bobbin 67 from both sides thereof, and an excitation coil 69 mounted on the perimeter of the winding portion where the one magnetic poles 43 of the magnetic cores 45 are mounted. The excitation coil 69 has a form of being wound around the perimeter of the magnetic poles 43 with the winding portion of the plastic coil bobbin.

The poles 41 and 43 of the magnetic cores 45 are each abutted one with another. The abutting portion of the poles 41 exposed out from the coil bobbin 67 has a gap formed thereat. A total of four soft magnetic member pieces 51 of rectangular-plate-shaped soft magnetic material, in two pairs, are on both side faces of the abutting portions of the magnetic poles 41 with the gap therebetween. Another four permanent magnets 53 with the same shape as that of the soft magnetic member pieces 51 are further thereupon. The soft magnetic member pieces 51 are of a material which has smaller permeability and less eddy current loss than the magnetic core 45, as with the first through third embodiments.

Further, two other soft magnetic member pieces 59 formed of the same material as the soft magnetic member pieces 51 in the second and third embodiments and longer than the soft magnetic member pieces 51 bridge the permanent magnets 53 each on the same side so as to connect the permanent magnets 53 on that side.

Figure 11:
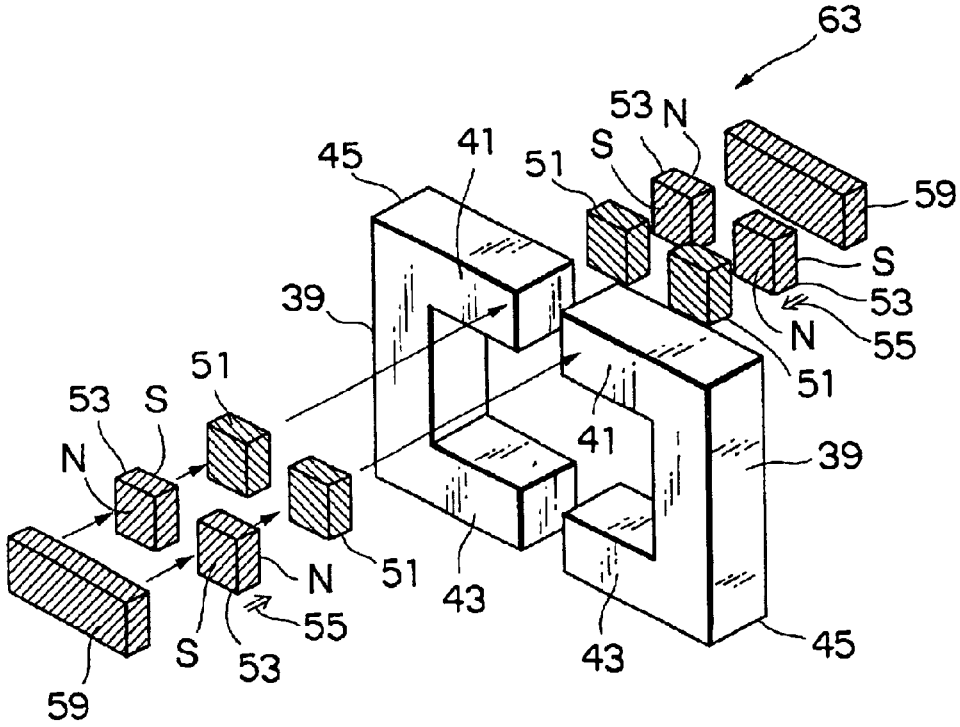
FIG. 11 is a disassembled perspective view of the magnetic core of the inductor component shown in FIG. 10.
Figure 12A:
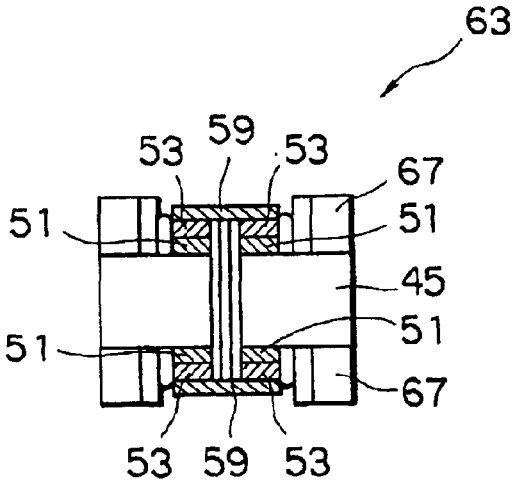
FIG. 12A is a plane view of the inductor component shown in FIG. 10.
Figure 12B:
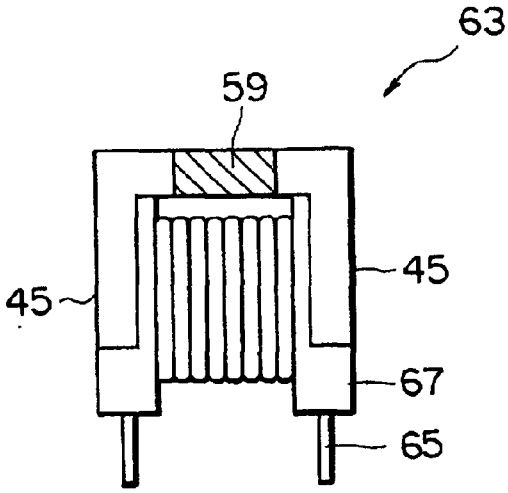
FIG. 12B is a frontal view of the same inductor component.
Figure 12C:
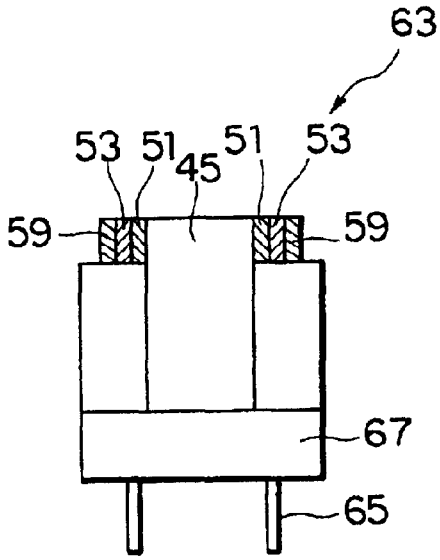
FIG. 12C is a side view of the same inductor component.

Referring to FIG. 11, the article is manufactured by mounting the magnetic poles 43 of the magnetic cores 45 into the hole (not shown) of the coil bobbin 67 comprising thereupon the excitation coil 69 such that the poles 43 abut, mounting permanent magnets 53 on both sides of the edges of the other magnetic poles 41 having a gap therebetween with the soft magnetic member pieces 51 each introduced therebetween, and further, other soft magnetic member pieces 59 are placed upon the permanent magnets 53 so as to bridge the pairs of permanent magnets 53. The arrow 55 indicates the direction of the magnetic field.

Next, specific examples of inductor components according to embodiments of the present invention having structures according to the first and second embodiments will be described in further detail.

Inductor components according to the first and second embodiments were prepared. The U-shaped soft magnetic member making up the magnetic cores 45 were formed of silicone steel (a 50 $\mu$m heavy-wind core) with high-saturation magnetic flux, having permeability of $2\times10^{-2}$H/m, magnetic path length of 0.2 m, and effective cross-section area of $10^{-4}$ $m^2$. The rectangular-pole-shaped soft magnetic members are formed of dust material 10×10×2 mm in dimensions, with permeability of $1\times10^{-4}$H/m and saturation magnetic flux density of 1 T. The permanent magnets have properties of coercive force of 398 A/m or stronger and residual magnetic flux density of 1 T or greater. For comparison, an inductor component according to a conventional example was fabricated in the same manner.

Figure 13:
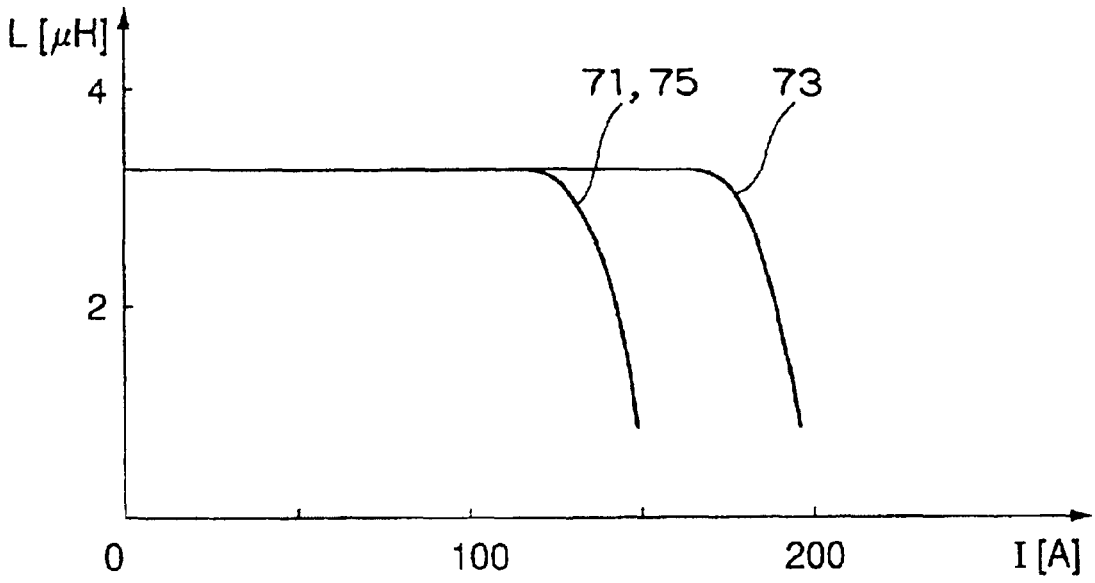
FIG. 13 is a diagram illustrating the DC superimposing properties of the inductor component according to the first embodiment of the present invention.

The DC superimposing properties of the inductor component 37 having such a configuration were measured. FIG. 13 shows the results thereof. In FIG. 13, the curves 71 and 73 correspond to the first and second embodiments, respectively, and the cure 75 corresponds to the conventional example. In FIG. 13, no change exists in the DC superimposing properties due to using the rectangular-pole-shaped soft magnetic members.

Also, the results of measuring the temperature properties at a driving frequency of 100 kHz are illustrated in the following Table 1.

TABLE 1

| Temperature Elevation ΔT(° C.) | U-shaped Soft Magnetic Member | Rectangular-pole-shaped Soft Magnetic Member | Permanent Magnet |
|---|---|---|---|
| Conventional Example | 10 | — | 30 |
| This Invention | 10 | 10 or less | 0 |

As can be clearly understood from Table 1, the inductor component according to the embodiments of the present invention has been shown to suppress generation of heat of the permanent magnets.

As described above, according to the embodiments of the present invention, an inductor component can be provided with few restrictions on the form of the disposed permanent magnets, with suppressed generation of heat by the permanent magnets due to the magnetic flux of the coil wound on the magnetic core, wherein the properties thereof do not deteriorate.

What is claimed is:

1. An inductor component comprising:

a magnetic core comprising at least one gap;

an excitation coil disposed on said magnetic core so as to form a magnetic path on said magnetic core;

at least one permanent magnet disposed near said at least one gap;

at least one first soft magnetic material piece disposed between said at least one permanent magnet and said magnetic core;

wherein said at least one first soft magnetic material piece is formed of a soft magnetic material which has a smaller permeability and less eddy current loss than said magnetic core;

wherein said at least one permanent magnet has a natural coercive force of at least 10 kOe (79 kA/m) and a Tc of at least 500° C.; and wherein said magnetic core comprises a magnetic material selected from the group consisting of silicone steel, amorphous material, Ni—Fe alloy, MnZn ferrite and NiZn ferrite.

2. An inductor component according to claim 1, wherein:

said at least one permanent magnet comprises at least one pair of permanent magnets;

said at least one first soft magnetic material piece comprises at least one pair of first soft magnetic material pieces;

each of said pair of permanent magnets is positioned on a respective side face of said magnetic core near said at least one gap with a respective one of said pair of first soft magnetic pieces disposed therebetween; and outer faces of said pair of permanent magnets are connected by a second soft magnetic material piece which has smaller permeability and less eddy current loss than said magnetic core.

3. An inductor component according to claim 1, wherein said magnetic core is U-shaped.

4. An inductor component according to claim 1, wherein said magnetic core comprises a pair of magnetic cores.

5. An inductor component according to claim 4, wherein said pair of magnetic cores comprises two C-type cores, and said plurality of gaps are formed at abutting edge faces of said C-type cores.

6. An inductor component according to claim 1, wherein said inductor component is adapted for use as a choke coil.

7. An inductor component comprising:

a magnetic core comprising at least one gap;

an excitation coil disposed on said magnetic core so as to form a magnetic path on said magnetic core;

at least one pair of permanent magnets, each said permanent magnet being positioned at a respective side face of said magnetic core near said at least one gap;

at least one pair of first soft magnetic material pieces, each said first soft magnetic material piece being disposed between a respective one of said permanent magnets and said magnetic core; and at least one second soft magnetic material piece connecting outer faces of said at least one pair of permanent magnets;

wherein said at least one pair of first soft magnetic material pieces and said at least one second soft magnetic material piece are formed of a soft magnetic material which has smaller permeability and less eddy current loss than said magnetic core.

8. An inductor component according to claim 7, wherein;

said at least one pair of permanent magnets comprises a first pair of permanent magnets disposed on a first side face of said magnetic core near said at least one gap, and a second pair of permanent magnets disposed on a second side face of said magnetic core near said at least one gap;

said at least one pair of first soft magnetic material pieces comprises a first pair of first soft magnetic material pieces disposed between said first pair of permanent magnets and said magnetic core, and a second pair of first soft magnetic material pieces disposed between said second pair of permanent magnets and said magnetic core; and said at least one second soft magnetic material piece comprises a first second soft magnetic material piece connecting outer faces of said first pair of permanent magnets, and a second second soft magnetic material piece connecting outer faces of said second pair of permanent magnets.

9. An inductor component according to claim 7, wherein said magnetic core is U-shaped.

10. An inductor component according to claim 7, wherein said magnetic core comprises a pair of magnetic cores.

11. An inductor component according to claim 10, wherein said pair of magnetic cores comprises two C-type cores, and said plurality of gaps are formed at abutting edge faces of said C-type cores.

12. An inductor component according to claim 7, wherein said inductor component is adapted for use as a choke coil.

* * * * *

UNITED STATES PATENT AND TRADEMARK OFFICE

CERTIFICATE OF CORRECTION

PATENT NO. : 6,734,771 B2
APPLICATION NO. : 10/016038
DATED : May 11, 2004
INVENTOR(S) : Kazuyuki Okita et al.

It is certified that error appears in the above-identified patent and that said Letters Patent is hereby corrected as shown below:

After Item (65) , line 2,
insert --Item (30) Foreign Application Priority Data
11/20/2000 (JP) …….352454/2000--.

Signed and Sealed this

Fifth Day of September, 2006

JON W. DUDAS
*Director of the United States Patent and Trademark Office*